US005228212A

United States Patent [19]

Turetta et al.

[11] Patent Number: 5,228,212

[45] Date of Patent: Jul. 20, 1993

[54] METHOD AND APPARATUS FOR CONTROLLING THE DRYING STAGE IN A CLOTHES DRYER, WASHING MACHINE OR THE LIKE

[75] Inventors: Daniele Turetta, Ispra; Claudio Civanelli, Travedona, both of Italy

[73] Assignee: Whirlpool International B.V., Veldhoven, Netherlands

[21] Appl. No.: 776,157

[22] Filed: Oct. 15, 1991

[30] Foreign Application Priority Data

Oct. 18, 1990 [IT] Italy ..... 21789 A/90

[51] Int. Cl.[5] ..... F26B 3/00

[52] U.S. Cl. ..... 34/27; 34/133 L; 34/55; 34/77

[58] Field of Search ..... 34/27, 32, 73, 76, 77, 34/44, 133 J, 53, 54, 55, 48, 133 L

[56] References Cited

U.S. PATENT DOCUMENTS 4,485,566 12/1984 Vivares ..... 34/55
4,546,554 10/1985 Bullock et al. ..... 34/55
4,738,034 4/1988 Muramatsu et al. ..... 34/55
4,827,627 5/1989 Cardoso ..... 34/55

*Primary Examiner*—Henry A. Bennet
*Assistant Examiner*—Denise L. Gromada
*Attorney, Agent, or Firm*—Thomas E. Turcotte; Stephen D. Krefman; Thomas J. Roth

[57] ABSTRACT

A method for controlling the length of a cycle for drying clothes contained in the drum of a clothes dryer machine, comprising measuring the quantity of water released by the clothes within a predetermined time during their drying, a signal being provided for stopping the machine if the measurement obtained is less than a predetermined value. The method includes measuring the quantity of water released from the clothes during their drying and employs apparatus to generate signals based on this measurement, the signals being fed to a control unit which controls air circulation through the drum and heating of the circulated air, the control unit monitoring the measured water released quantity, and acting to terminate the drying cycle when the variation has a negative gradient and when the signals correspond to a measured water quantity which is constant with time.

43 Claims, 7 Drawing Sheets

METHOD AND APPARATUS FOR CONTROLLING THE DRYING STAGE IN A CLOTHES DRYER, WASHING MACHINE OR THE LIKE

DESCRIPTION

This invention relates to a method and apparatus for controlling the drying stage in a clothes dryer, washing-drying machine or the like of the type comprising a drum, usual means for generating hot air circulation through the drum to dry the clothes contained therein, at least one tank or vessel for collecting the water removed from said clothes by the air and condensed at one or more of said means during said circulation, and a pump for removing said water from said vessel, advantageously cyclically.

In particular, the clothes dryer or the like is of the closed circuit type, i.e. comprising a heat exchanger for recovering the water removed from the clothes during the drying process. This water condenses at said heat exchanger and is collected in said vessel.

Various methods (and consequently apparatus) are already known for monitoring and halting drying on the basis of the residual water quantity present in the clothes.

One of these methods and apparatus measures the load (clothes) resistivity, which is inversely proportional to its water content. For this purpose said apparatus comprises positive and negative electrodes arranged along the drum wall.

This method and apparatus have however various drawbacks connected with the fact that the part undergoing resistivity measurement is only that part in contact with said electrodes.

It can therefore happen that a still moist part of the load (clothes) is not in contact with the electrodes during the resistivity measurement. This measurement is therefore erroneous, resulting in the stoppage of the drying operation before that part of the clothes is completely dry.

To obviate this drawback the drying operation is prolonged for some tens of minutes beyond the time when the measurement indicates that the clothes are completely dry.

However this method of operation results in greater energy consumption of the clothes dryer, greater stressing of the means which generate the air circulation through the machine and the danger of damage to any already completely dry clothes contained in its drum.

Thus summarizing, known systems are not reliable, consume a large energy quantity and can damage the clothes contained in the drum. An object of the present invention is to provide a method and apparatus for controlling the drying stage in a clothes dryer or washing-drying machine which are reliable, are of simple implementation and construction, and cannot damage the clothes contained in the machine.

A further object of the invention is to provide a method and apparatus which enable the drying stage of a machine of the stated type to be controlled in an optimum manner independently of the type of fabric and the weight of the clothes contained in the machine drum.

A further object is to provide an apparatus for implementing the aforesaid method which requires no modification to the normal drums of known clothes dryers (or the like).

These and further objects which will be apparent to the expert of the art are attained by a method of the stated type used in a clothes dryer or the like of the aforesaid type, characterized by measuring, for the purpose of controlling the clothes drying stage, the quantity of water released by the clothes within a predetermined time during their drying, and providing a signal for stopping the machine if the measurement obtained is less than a predetermined value.

To implement the aforesaid method, a clothes dryer or the like of the stated type is provided comprising measurement means to measure the quantity of water released from the clothes during their drying and to generate signals based on this measurement, said signals being fed to a control unit which is connected to at least one of the means for generating the air circulation through the drum and for heating said air, said unit monitoring the variation in said measured water quantity and acting on said means when said variation has a negative gradient and when the signals originating from the measurement means correspond to a measured water quantity which is constant with time.

The present invention will be more apparent from the accompanying drawing, which is provided by way of non-limiting example and in which.

Figure 8:
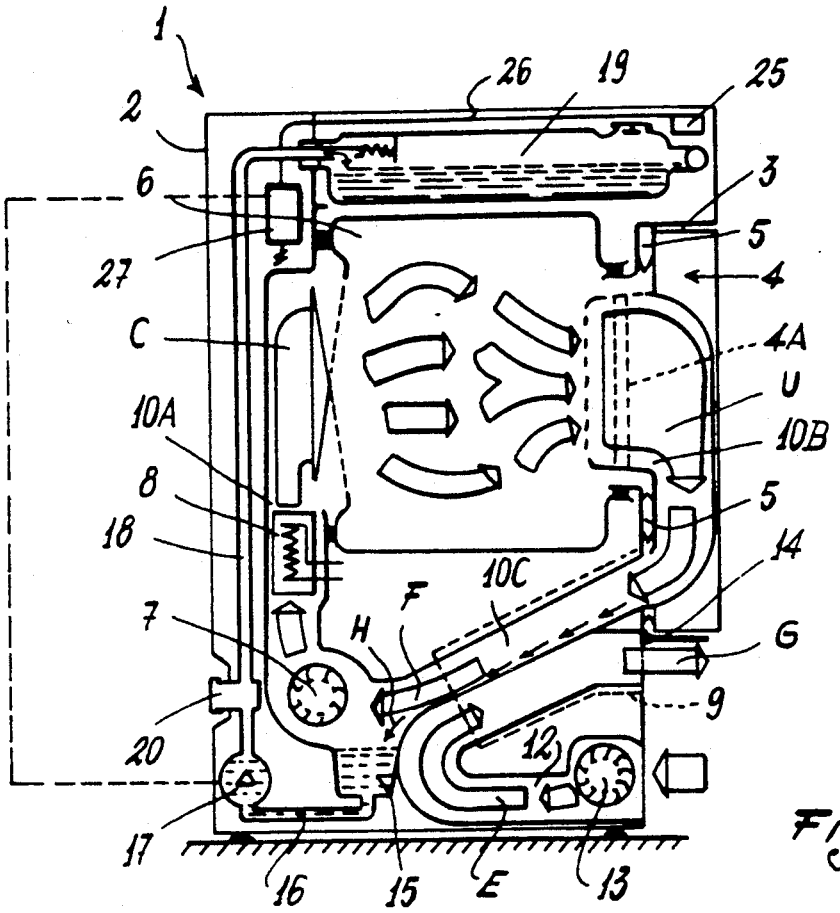
FIG. 8 is a schematic side sectional view of a modified embodiment of a clothes dryer according to the invention.
Figure 9:
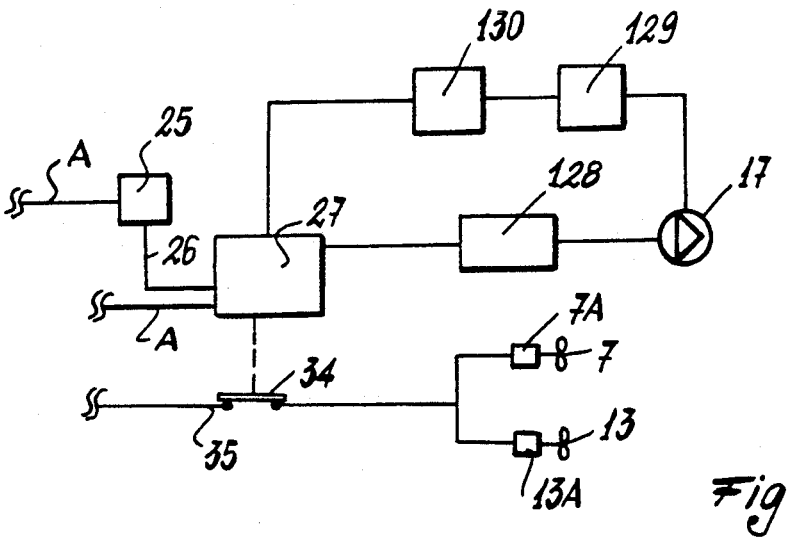
FIG. 9 is a schematic block diagram of an apparatus in accordance with said modified embodiment of the invention.
Figure 10:
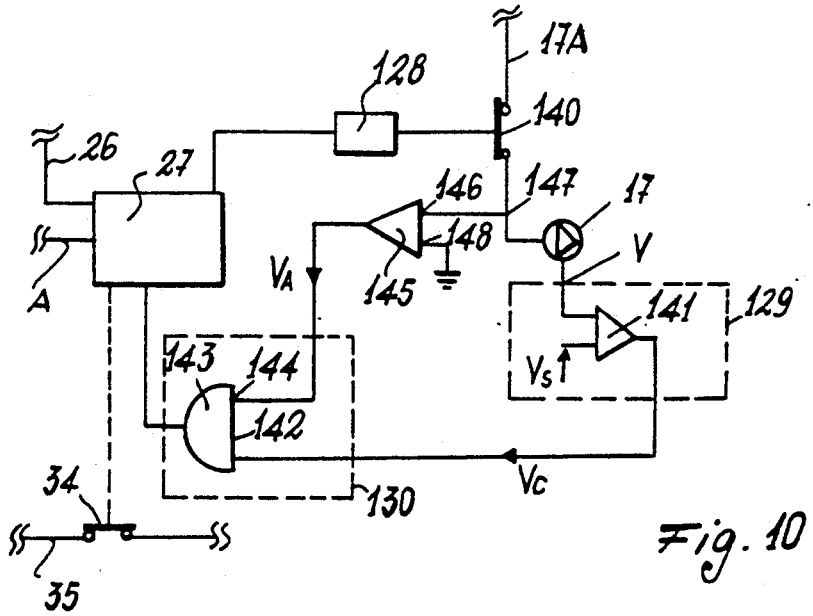
Figure 11:
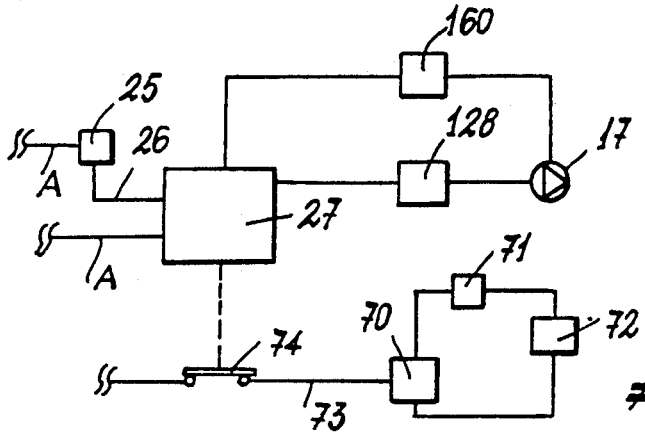
Figure 12:
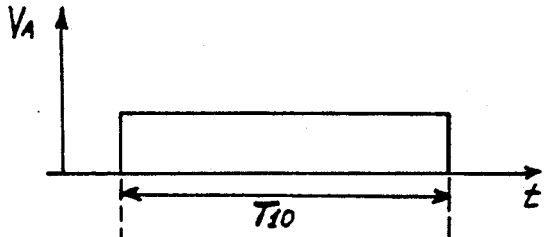
Figure 13:
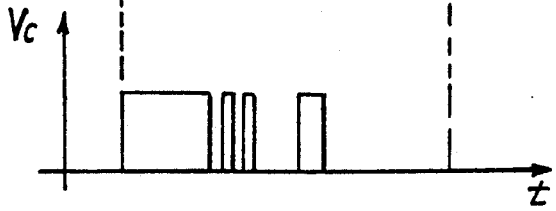
Figure 14:
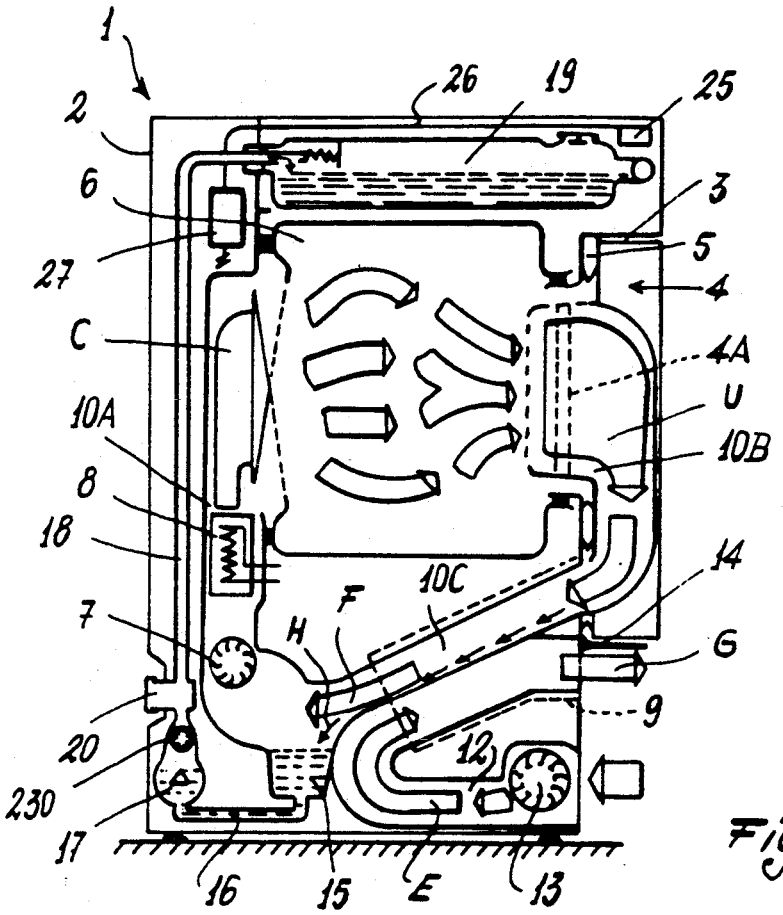
Figure 15:
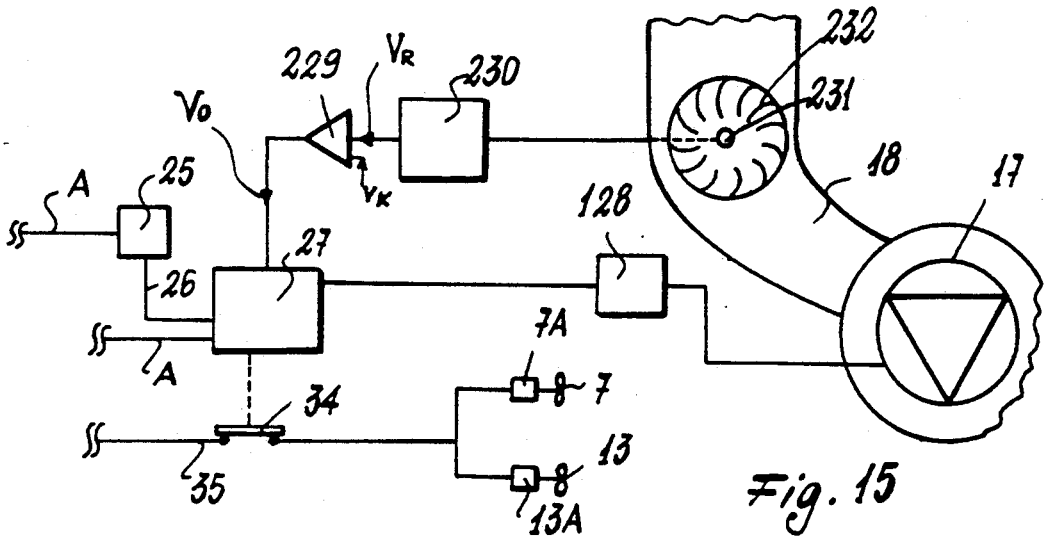
Figure 16:
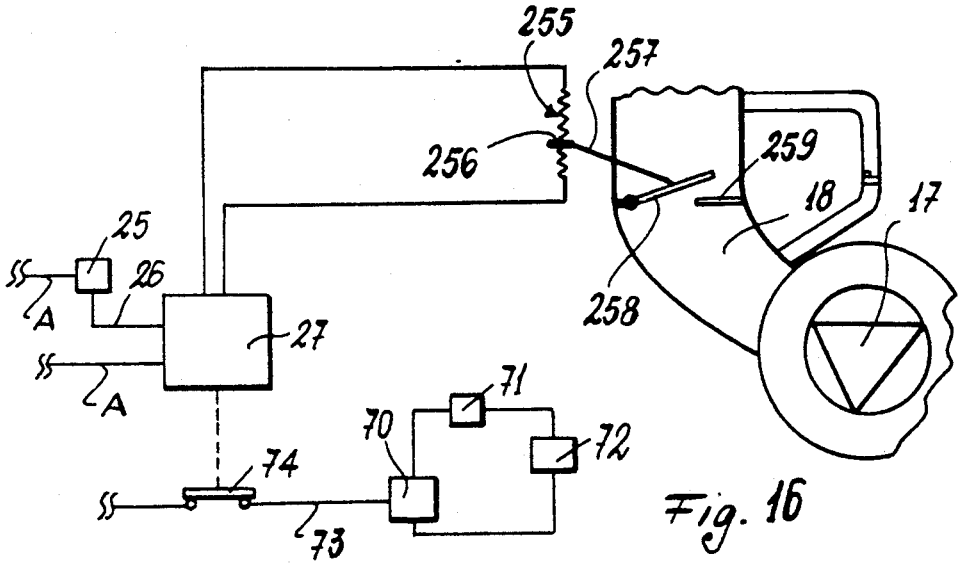

FIG. 10 schematically represents an example of part of the apparatus of FIG. 9;

FIG. 11 represents a further embodiment of the apparatus of FIG. 9;

FIGS. 12 and 13 represent the time period during which the usual pump of the machine of FIG. 8 is enabled to operate and, respectively, the time period during which this pump actually operates on the condensed water present in a collection vessel of the machine;

FIG. 14 is a schematic sectional side view of a further embodiment of a clothes dryer according to the invention;

FIG. 15 is a schematic block diagram of an apparatus in accordance with the different embodiment of the invention shown in FIG. 14;

FIG. 16 represents an example of the apparatus of FIG. 15; and

Figure 17:
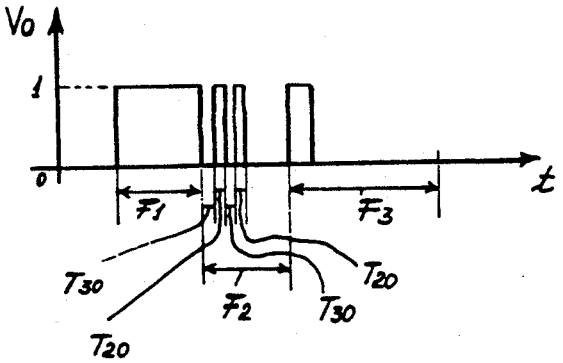

FIG. 17 represents the time period during which, according to one characteristic of the invention, the energy transferred from the water discharged by the clothes to a mobile member positioned in the discharge pipe.

With reference to FIGS. 1 to 7, a clothes dryer is indicated overall by 1 and comprises a cabinet 2 with an aperture 3, to coincide with which there is positioned a door 4 provided with usual seal gaskets 5 and in which a filter element 24A is disposed.

The aperture 3 provides access to a usual drum 6 through which hot air circulation is generated to dry the clothes (not shown).

Means are provided to produce this circulation and heating, said means being (in the example shown in FIG. 1 and in FIGS. 2 to 5) a fan 7, a resistance element 8, a heat exchanger 9 and relative ducts 10A for feeding dry hot air C into the drum 6, 10B for removing the wet hot air U therefrom (provided partly within the door 4) and 10C for feeding cold air F to said fan 7. This air F originates from the heat exchanger 9 which in the example is of the countercurrent type. Cold air E originating from the outside of the cabinet 2 passes through it by being fed through a duct 12 by a second fan 13. The duct 12 opens again to the outside of the cabinet 2 via an aperture from which hot air G emerges.

The water H contained in the moist hot air U condenses as this latter passes through the heat exchanger 9 and falls into a first collection vessel 15. This is connected via a pipe 16 to a pump 17 from which a further pipe 18 extends to terminate in a second collection vessel 19.

Alternatively the pipe 18 can be closed by a deflector or deviator (not shown) which connects the pump 17 to an aperture 20 opening into the cabinet 2 and which can be connected to a usual water discharge pipe.

The vessel 19 (or upper vessel) is advantageously removable to allow the demineralized water contained in it to be used for known purposes.

The machine 1 is a closed-circuit clothes dryer having for example four different drying levels selectable by the user from a usual control panel (not shown) connected to a known drying level selector 25.

According to the invention the machine 1 comprises means for monitoring and controlling the drying operation in accordance with the quantity of water present in at least one of said two vessels 15 and 19.

Specifically, the drying selector 25 is connected via a connection 26 to a control unit 27 advantageously of microprocessor type. This latter is connected to means which measure the water variation in at least one of said two vessels 15 or 19 and is able to act on at least one of the means (for example the fans 7 and 13 and the resistance element 8) which circulate and heat the drying air.

Figure 2:
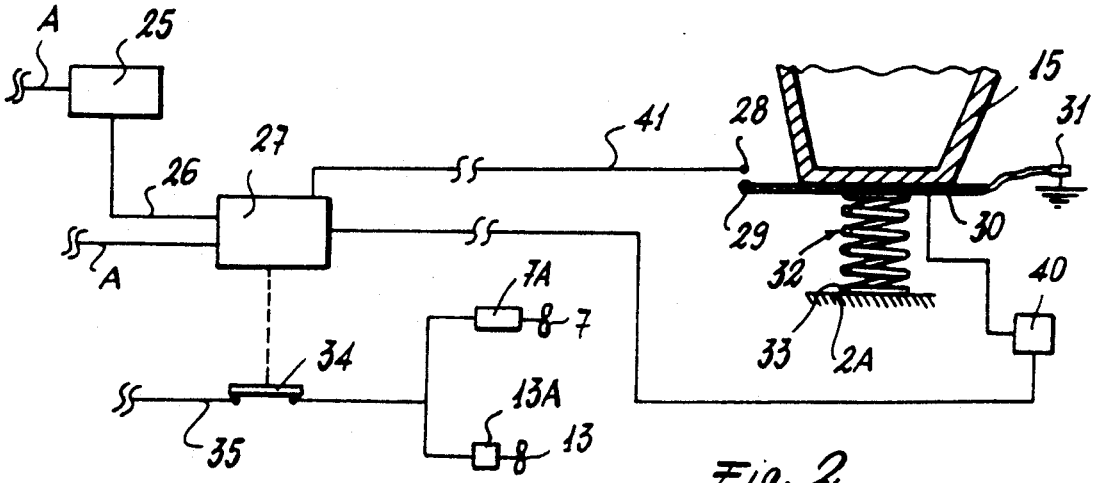
FIG. 2 is a schematic block diagram of an apparatus according to the invention.

With reference to FIG. 2, the control unit 27 is connected to a contact 28 normally open during the drying stage and arranged to cooperate with a contact 29 connected to a plate 30 flexibly connected to an element 31 connected to earth.

The plate 30 supports the vessel 15 and rests on an elastic element or compression spring 32 which rests on, and is rigid at its end 32 with, a fixed part 2A of the cabinet 2. The vessel 15 is also operationally connected (in any known manner) to a usual dynamometer 40.

The control unit 27 is connected to said dynamometer 40 and is also operationally connected to a contactor 34 provided in the power feed line 35 to the motors 7A and 13A of the fans 7 and 13 and normally closed during machine operation.

FIG. 2 also shows the power feed lines A for the various components shown in this figure.

Figure 1:
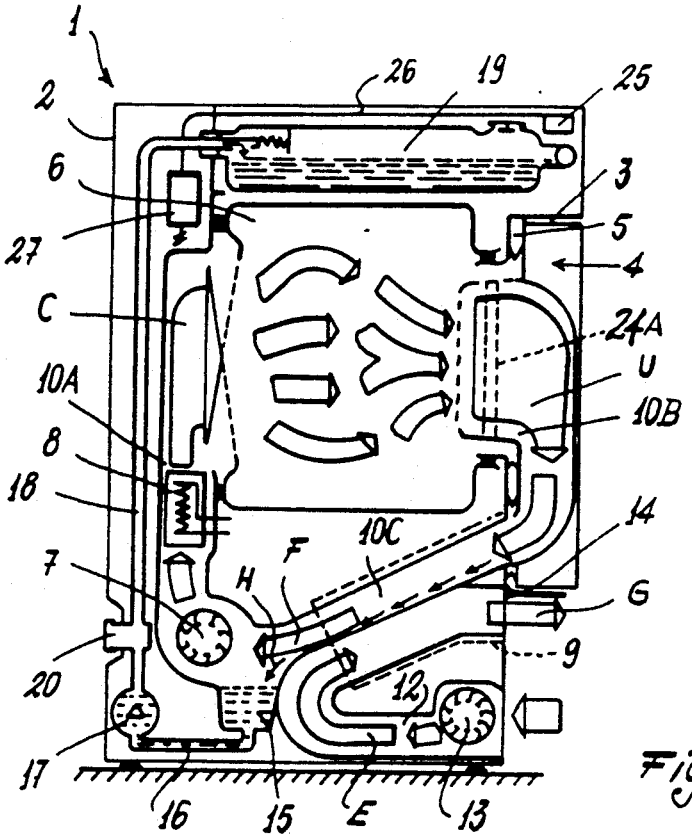
FIG. 1 is a schematic sectional side view of a clothes dryer according to the invention.

It will be assumed that a clothes dryer constructed in accordance with FIGS. 1 and 2 is to be used.

With such a machine, during the drying of the clothes contained in the drum 6 the pump 17 operates cyclically for a determined time period, to pump the water H removed form the clothes from the (lower) vessel 15 to the (higher) vessel 19 or to empty the lower vessel 15.

Figure 6:
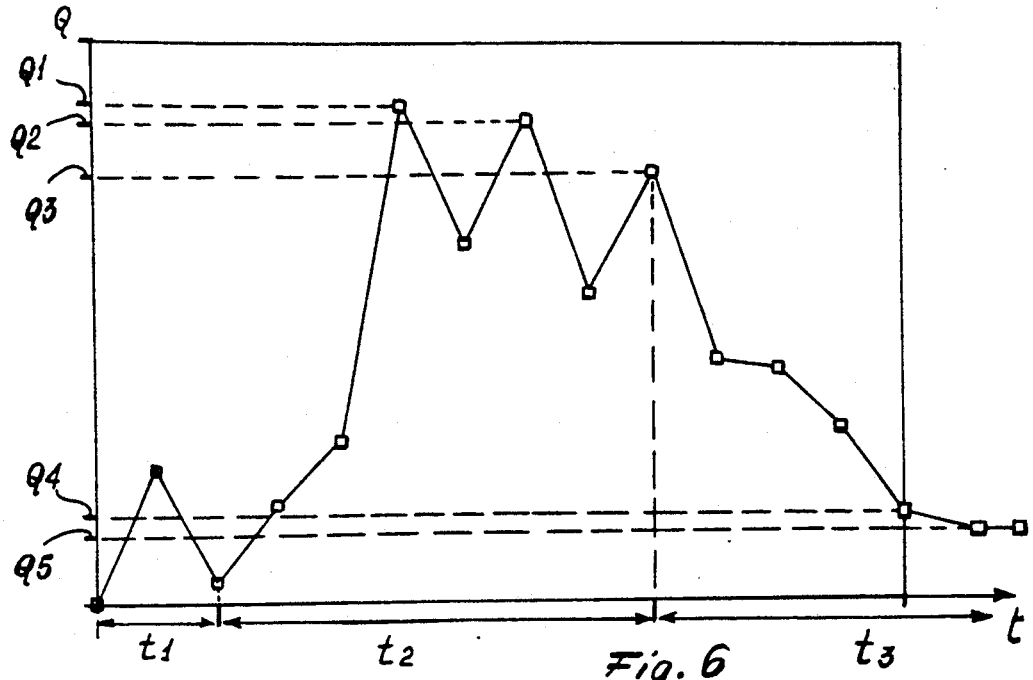
FIGS. 6 and 7 are graphs in which the horizontal axis represents the time "t" during which the usual pump of the machine of FIG. 1 operates, and the vertical axis represents the water quantity Q present in a first vessel (FIG. 6) and in a second vessel (FIG. 7) of the machine of FIG. 1.

With reference also to FIG. 6, each cyclic operation of the pump 17 provides corresponding (at least partial) emptying of the vessel 15.

As can be seen from this figure, after an initial time $t_1$ there is a time period $t_2$ during which the pump extracts from the vessel 15 a water quantity which continually increases until the peaks corresponding to quantities Q1, Q2 and Q3 are attained.

After this period there is a further time period $t_3$ during which the quantity extracted continually decreases until the levels Q4 and Q5 are reached. After this period, any further operation of the pump 17 extracts only a water quantity Q5 (or less), corresponding to the water head usually present within the lower vessel 15.

During pump operation the unit 27 measures the variation in the weight of said vessel by the dynamometer 40 (or equivalent means). Consequently this unit measures the variation in the water quantity Q present in said vessel and hence the variation in the water quantity removed from the clothes in the drum 6 during their drying.

When this quantity reaches said value Q5, the contact 29 touches the contact 28.

Thus on the basis of the data originating from the dynamometer 40 and from a line 41 connected to the contact 28 (which generates a further enabling signal), the unit 27 determines when the water quantity in the vessel 15 has reached a value substantially constant with time. Thus it determines when the drying of the clothes can be considered complete by virtue of the fact that no more water is discharged from them or that the water discharge corresponds only to the usual moisture naturally present in the clothes. Consequently the unit 27 operates the contactor 34 so that this opens. This interrupts power feed to the motors 7A and 13A and clothes drying is therefore halted.

A further contact, not shown, also cuts off power feed to the resistance element 8 and pump 17.

The described method for halting drying can also be applied, with obvious modifications, to evaluating the water quantity in the upper vessel 19 (if provided).

Figure 7:
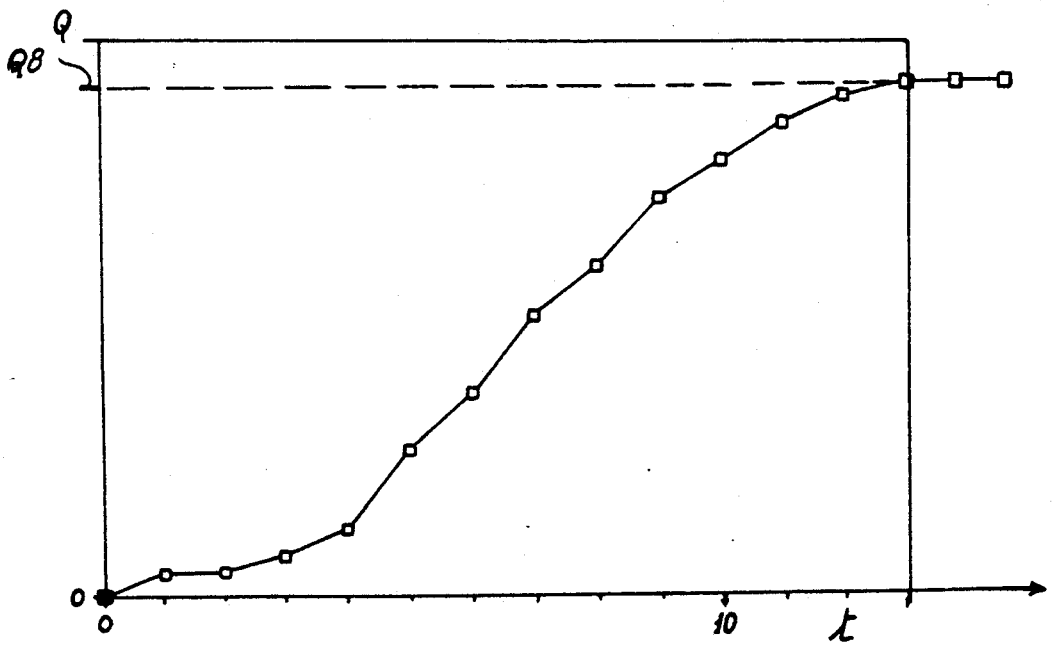

In this case the dynamometer 40 measures an increase in the water in this collection vessel and feeds data to the unit 27, these data lying substantially on a curve such as that shown in FIG. 7

The value Q8 in FIG. 7 corresponds to the value Q5 in FIG. 6. With this modification when the unit 27 determines that the water quantity in the vessel 19 reaches and is maintained at said value Q8, it interrupts drying in the aforedescribed manner.

It should be noted that the values Q5 and Q8 can also not correspond to complete water removal from the clothes present in the drum 6. In this respect, it is not important to determine this complete removal condition (i.e. it is not important to determine when there is no further production of water H from the heat exchanger 9), because this signifies that the clothes no longer possess the natural moisture which they normally retain and which is equal to about 7–8% of their total weight.

Therefore it is pointless and counter-productive to insist on eliminating this residual moisture (for obvious energy reasons). In this respect a garment is considered dry when after washing and drying it returns to its original weight, which also comprises the natural moisture contained in it.

Figure 3:
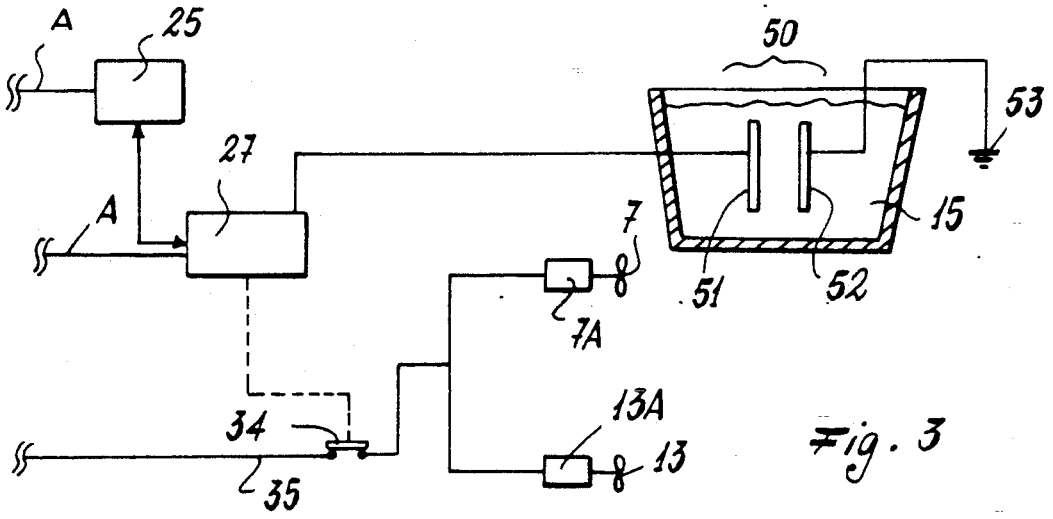
FIGS. 3 to 5 are schematic block diagrams of different embodiments of the apparatus of FIG. 2.
Figure 4:
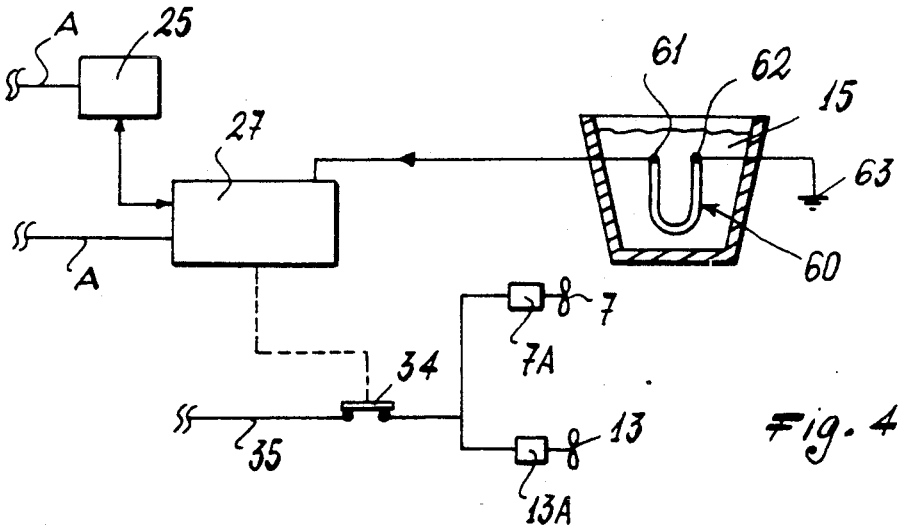

FIGS. 3 and 4 show further embodiments of the apparatus according to the invention using electrical components as measurement means for the water quantity in the vessel.

In these figures parts corresponding to those of FIGS. 1 and 2 carry the same reference numerals.

Specifically, in FIG. 3 the means enabling the unit 27 to determine the variation in the water quantity removed from the clothes and present in the vessel 15 (or in the vessel 19) consist of a capacitor 50 comprising two flat parallel plates 51 and 52, one of which (51) is connected to the unit 27 and the other (52) is connected to earth at 53. The capacitor is powered by the unit 27.

In operation, the apparatus uses the variation in the capacitance of the capacitor 50 deriving from the variation in its dielectric constant.

In this respect, as said capacitance is directly proportional to the value of the dielectric constant, when the water quantity between the plates reduces there is a consequent reduction in the dielectric constant, and hence a reduction in this capacitance. This reduction in terms of suitable comparison parameters is proportional to the residual water quantity in the vessel 15. The unit 27 therefore evaluates this quantity, and halts the drying process in the manner already described with reference to FIG. 2, when said water quantity remains substantially constant with time (i.e. when the capacitance of the capacitor 50 remains substantially constant).

Again in this case, the control unit 27 determines data lying on curves similar to those of the already described FIGS. 6 or 7, depending on whether the capacitor 50 is positioned in the lower collection vessel 15 or upper vessel 19.

In the case of FIG. 4, the means which determine the water quantity in the collection vessel 15 or 19 are a wire resistor 60 the ends 61 and 62 of which are connected to the unit 27 and to an earth point 63 respectively. This resistor is powered for example by said unit.

In this case the unit 27 determines water quantity in the vessel by the variation in the characteristics of the resistor 60. In this respect the ohmic value of this component varies according to the water level in the vessel. As the water short-circuits the resistor, the extent of short-circuiting differs according to the water level reached, giving rise to corresponding different resistance values.

Based on the measured value, the unit 27 evaluates (by means of known preset algorithms) the water quantity in the vessel (and hence the water quantity removed from the clothes during their drying), to operate the mobile contact 34 and halt the drying process in a manner similar to that already described. Again in this case, the measured data processed by the unit 27 and corresponding to the water quantity in the vessel lie on curves substantially similar to those of FIGS. 6 and 7, already described.

Figure 5:
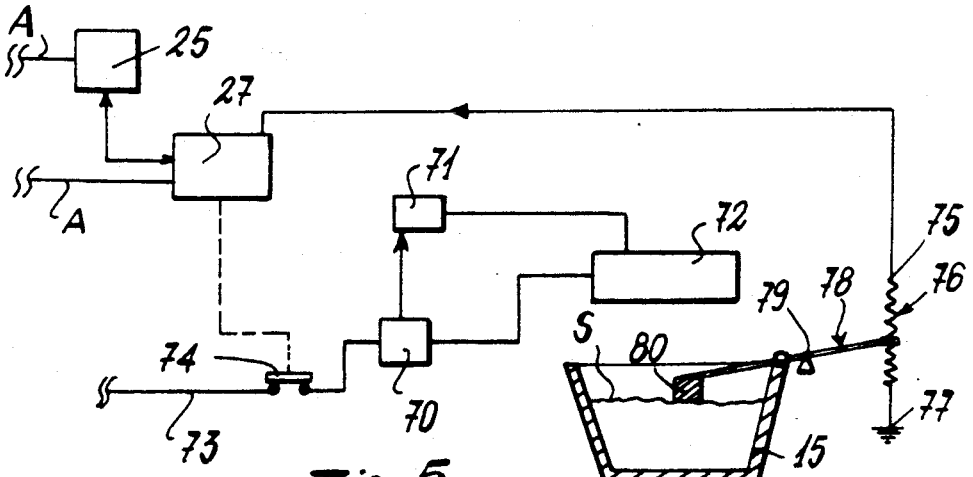

FIG. 5 shows a further modification of the apparatus according to the invention in which parts corresponding to those of the already described figures are indicated by the same reference numerals. This apparatus uses electrical and mechanical components for measuring the water quantity in the vessel 15 or 19 and hence the water quantity removed from the clothes during their drying.

In FIG. 5 the circuit for producing hot air is a usual refrigeration circuit comprising substantially a compressor 70, a condenser 71 and an evaporator 72, the compressor 70 being connected to a power feed line 73 which includes a contactor 74 normally closed during machine operation.

In the apparatus according to the invention the unit 27 is connected to one end 75 of a variable resistor 76, the other end 77 of which is connected to earth. The resistor is fed for example by said unit 27.

The characteristics of the resistor 76 are varied by a lever 78 pivoted at 79 (this point can be rigid with a fixed part of the cabinet 2 of the machine 1 or with the structure of the vessel 15) and carrying at its free end a float 80 which rests on the surface 5 of the water present in the collection vessel (for example the lower vessel 15).

As the water level in the vessel varies the position of the float 80 varies and hence the position of the lever 78 on the resistor 76 also varies. This latter therefore varies its ohmic value according to the position of the float in the vessel and hence according to the water level.

In accordance with preset known algorithms, the unit 27 converts this variation in the resistor characteristics into data (matching the curves 6 and 7) relative to the water quantity in the vessel and hence to the water quantity removed from the clothes during their drying.

On the basis of said data the unit 27 therefore opens the contactor 74 when the ohmic value of the resistor 76 remains constant with time. In this manner the operation of the compressor 70 stops, as does the drying process (the unit 27 also halts the motors of the usual air circulation fans).

FIGS. 8 to 13 show other embodiments of the invention. In these figures, parts corresponding to those of the previously described figures are indicated by the same reference numerals. With reference to said figures, the water quantity released from the clothes contained in the drum 6 during their drying is determined indirectly, in contrast to the embodiments of FIGS. 1 to 7.

In this respect, this determination is done by measuring the variation of at least one characteristic quantity of the pump during drying, as described hereinafter.

Specifically, in the embodiments of the invention shown in FIGS. 8 to 13, the machine 1 comprises means for measuring the current absorbed by the pump 17 during evacuation of the water from the vessel 15 and means for measuring the gradient of the current absorbed by this pump during its operation. As described hereinafter, on the basis of this measurement the water quantity removed from the clothes during drying can be determined.

The drying selector 25 is connected via the connection 26 to a control unit 27 analogous to that of FIGS. 2 to 5. This unit is connected to a usual timer 128 which provides for cyclic operation of the pump 17.

As already stated, this latter is usually set to operate for a time period (e.g. 20–25 seconds) during which the pump 17 evacuates water from the vessel 15. This period is followed by a longer period (e.g. 120–150 seconds) during which said pump is not in operation.

The timer 128 therefore cyclically defines these periods of operation (or non-operation) of the pump 17.

During its operation, the pump 17 absorbs current from the mains, this absorption being proportional (as is well known) to the torque generated by the pump motor. This torque is proportional to the resistant couple offered by the water being evacuated from the vessel 15.

Consequently, (as explained hereinafter) by measuring said absorbed current and its variation with time it is possible to determine the water quantity evacuated from the vessel 15 and its variation with time. This enables the water quantity removed from the clothes during their drying to be obtained.

For this purpose the pump 17 is connected to means 129 which evaluate the mains current absorbed by the pump, said means being connected to another timer 130 which evaluates (in analog or digital form) the time for which the pump 17 actually operates on the water of the vessel 15 (i.e. evacuates it).

The timer 130 can be either separate from the unit 27 or incorporated into it.

As described in relation to FIGS. 1 to 7, the control unit 27 also controls the contactor 34 which is connected into the line 35 powering the motors 7A and 13A of the fans 7 and 13, and is normally closed during operation of the machine 1. The unit 27 also operates in known manner (not shown) on the resistor 8.

The figures under examination also show the power feed lines A for the various components represented in these figures.

FIG. 10 shows a schematic example of part of the circuit of FIG. 9.

In FIG. 10, in which parts corresponding to those of FIGS. 8 and 9 are indicated by the same reference numerals, the timer 128 operates on a contactor 140 which during the use of the clothes dryer closes a line 17A powering the pump 17.

This latter is connected to a comparator 141 arranged to compare a signal V corresponding to the drive torque generated by the pump motor with a threshold signal $V_S$. The comparator 141 is connected to one input 142 of a logic operator (for example an AND gate) 142, the other input 144 of which is connected to an output of a further comparator 145.

This latter has one input 146 connected to a point 147 between the contactor 140 and the pump 17, and the other input 148 connected to earth. The output of the AND gate 143 is connected to the unit 27.

It will now be assumed that a clothes dryer constructed in accordance with FIGS. 8, 9 and 10 is to be used. In such a machine the pump 17 operates cyclically for a determined time period ($T_{10}$ in FIG. 5), to pump the water for example from the lower vessel 15 to the higher vessel 19 (or to empty the lower vessel 15).

To operate the pump 17 in this manner, the unit 27 causes the timer 128 to close the contactor 140 in the line 17A so as to power said pump.

this latter generates a drive torque which is proportional to the current absorbed from the mains, this being evaluated on the basis of a signal V taken in known manner from across the usual pump motor (not shown).

At the same time the comparator 145 receives a signal from the input 146 which corresponds to the "operation enabled" state of the pump. At the output of this comparator there is a logic signal $V_A$ (FIG. 12) corresponding to said "enabling", this signal being fed to the input of the AND gate 143.

The input 142 of this latter receives a further signal $V_C$ obtained from the comparator 141 by comparing the signal V with the threshold signal $V_S$. In this respect, while the motor of the pump 17 encounters during operation a determined resistant couple generated by a certain water quantity in the vessel 15 (couple corresponding for example to a water quantity just higher than the usual head always present in this collection vessel), said signal $V_C$ is greater than zero (see FIG. 13).

When however the resistant couple is very low (i.e. less than a value corresponding to said water quantity) or zero (if there is no longer any water in the vessel 15), the signal $V_S$ falls to zero.

If $V_C$ is other than zero, the AND gate 143 emits a logic signal 0. When $V_C$ falls to zero, this gate also emits a logic signal 0. In the first case the unit 27 detects that the pump 17 is operating on a (possibly variable) water quantity always greater than a minimum value (head) or zero. In the second case the unit 27 detects a negative variation of the pump drive torque and consequently that it is operating under no load (or on a water quantity less than said head).

In this latter case the unit 27 detects a negative variation in the water quantity removed from the clothes in the drum 6 during their drying.

If this no-load operation lasts until the end of the period $T_{10}$, the unit 27 calculates (in accordance with a suitable known algorithm) that there is no further water in the clothes and that the drying stage has ended.

In this case the unit acts directly or indirectly on the contactors 140 and 34 to thus halt the pump 17 and the fans 7 and 13, and also cuts off power feed to the resistor 8.

As an alternative to circuit operation on digital signals as heretofore described, the circuit of FIG. 2 can operate on analog signals.

In this case the means 129 which calculate the absorbed current (and thus finally the resistant couple provided by the water present in the vessel 15) can be a usual ammeter while the timer 130 can be a usual threshold circuit arranged to sense when the analog signal originating from the ammeter falls below a threshold value.

FIG. 11 shows a modification of the apparatus according to the invention. In this figure parts corresponding to those of FIGS. 8 to 10 are indicated by the same reference numerals.

In the figure under examination the circuit for producing the hot air is the refrigeration circuit of FIG. 5, comprising substantially a compressor 70, a condenser 71 and an evaporator 72, the compressor 70 being connected to a power feed line 73 which includes a contactor 74 normally closed during machine operation.

In the apparatus according to this modification of the invention the unit 27 is connected to the timer 128 operating on the pump 17. This latter is connected to a known tachometer dynamo 160 connected to the unit 27.

In this manner during operation of the machine 1, the r.p.m. of the pump motor is continuously monitored by the unit 27. As said r.p.m. varies inversely proportionally to said resistant couple (provided by the water), by monitoring it the unit 27 is able to calculate the variation in the water quantity drawn in by the pump from the collection vessel 15 and consequently the variation in the water quantity released by the clothes during their drying. In this respect, when the machine 1 is in operation, the unit 27 allows the timer 128 to power the pump 17 (in the same manner as heretofore described in relation to FIGS. 8, 9 and 10), so causing it to operate.

During pump operation and in particular during the initial stages of drying, the water quantity released from the clothes is high and therefore the water quantity falling into the vessel 15 is large. Consequently the resistant couple generated by the water against the pump is high and the r.p.m. of the pump motor is therefore low.

As drying proceeds, progressively less water is released from the clothes to fall into the vessel 15, and therefore the resistant couple generated against the pump also reduces. In this case the motor r.p.m. rises proportionally until it remains constant with time when the pump 17 rotates under no load.

This variation is measured by the tachometer dynamo, which feeds its data to the control unit 27.

Using an appropriate algorithm, this latter calculates the mains current absorbed by the pump 17 on the basis of said r.p.m., this current being inversely proportional to said r.p.m. and thus directly proportional to the water quantity released from the clothes during their drying.

The unit 27 thus detects a negative variation with time in the current absorbed by the pump and halts drying (by acting for example on the compressor 70 and on the timer 128) when this current remains substantially constant with time or falls below an appropriate threshold valve corresponding to a pump r.p.m. able to remove from the vessel 15 the usual water head always present in said vessel.

Other embodiments of the invention are shown in FIGS. 14 to 18, in which parts corresponding to those of the previously described figures are indicated by the same reference numerals. In these embodiments, the water quantity removed from the clothes during their drying (and its variation with time) is calculated from the energy transferred to mobile means disposed in a pipe upstream or downstream of the pump 17.

For this purpose the machine 1 comprises means for measuring the energy transferred by the water evacuated by the pump 17 from the vessel 15, to a mobile member disposed (in the example under examination) in the pipe 18 and means for measuring the gradient of the variation in this transferred energy during the operation of the clothes dryer 1.

Specifically (see FIG. 15) the drying selector 25 is connected to a control unit 27 similar to that described in the preceding figures. This unit is connected to the timer 128 to determine cyclic operation of the pump 17, as heretofore described.

The timer 128 therefore defines cyclic periods of operation (or non-operation) of the pump 17, one of which is shown in the previously described FIG. 12.

The pump 17 is connected to a comparator 229 (or similar member or circuit), one input of which is connected to a tachometer dynamo 230 (or another similar member). The other input of the comparator 229 receives a suitable chosen reference signal $V_K$. The tachometer dynamo (or the like) measures the rotational speed of an idle shaft 231 on which there is fixed an impeller 232 positioned in the pipe 18 (which can be the discharge pipe or the pipe carrying the water from the vessel 15 to the vessel 19). The shaft 231 at least partly projects into this pipe. This is achieved for example by forming a hole (not shown) in this latter and providing usual seal means about said shaft.

The control unit 27 is also operationally connected to the contactor 34 which is incorporated in the line 35 powering the motors 7A and 13A of the fans 7 and 13 and is normally closed during operation of the machine 1. The unit 27 also operates in known manner (not shown) as already stated on the power supply to the pump 17 and to the resistor 8.

The figures under examination also show the power feed lines A for the various components present in this figure.

It will now be assumed that a clothes dryer constructed in accordance with FIGS. 14 and 15 is to be used.

As already stated, in such a machine the pump 17 operates cyclically for a determined time period ($T_{10}$ in FIG. 12), to pump the water for example from the lower vessel 15 to the higher vessel 19 (or to empty the lower vessel 15).

To operate the pump 17 in this manner, the unit 27 causes the timer 128 to close a contactor (not shown) in the line powering said pump. This pump therefore rotates.

With the operation of the pump the condensed water passes from the vessel 15 into the pipe 18 where it cooperates with the impeller 232.

The energy transferred by the pump 17 to the fluid is thereby retransferred by this fluid to the impeller, which therefore rotates.

The rotational speed of the shaft 231 of the impeller 232 is measured in known manner by the dynamo 230, which generates electrical signals $V_R$ based on this measurement.

The signals $V_R$ are compared in the comparator 229 with the reference or threshold signals $V_K$. As a result of this comparison the comparator generates signals $V_O$ (logic signals in the example of FIG. 15), which are fed to the control unit 27.

In this respect, during the initial stage of drying $F_1$, a large water quantity is present in the clothes contained in the drum 6. This water, removed by the hot air, condenses into the vessel 15 from which it is evacuated by the pump 17.

During the stage $F_1$, the water flow rate to the pipe 18 is therefore high. The water at this flow rate strikes the impeller to rotate it.

The rotational speed of the shaft 231 of the impeller 232 is measured by the tachometer dynamo 230 which generates the signals $V_R$ as stated. These signals are compared with the signals $V_K$ to generate an output from the comparator 229 which is "high" (equal to 1). This high output or level 1 remains for the entire stage $F_1$, During the second stage $F_2$ the water quantity in the clothes begins to fall. Consequently the water flow rate through the pipe 18 also falls. Specifically, during some periods $T_{20}$ the flow rate is still sufficient for the signal $V_R$ generated by the dynamo 230 to exceed the signal $V_K$. Consequently during these periods the output $V_O$ is equal to 1. During other periods $T_{30}$, the flow rate is insufficient and the impeller does not rotate. During these periods the signal $V_R$ is less than $V_K$ and therefore $V_O$ is zero.

During the third stage $F_3$ there is a single high passage of the signal $V_O$ followed by zero output from the comparator 29. In this stage, if the period during which $V_O$ is zero lasts until termination of the period $T_{10}$ of FIG. 12 or at least for a predetermined fraction of it, the unit 27 calculates (again on the basis of suitable known comparison algorithms) that there is no more water in the clothes contained in the drum 6, or rather that they contain only a minimum quantity equivalent to their natural water content.

Thus summarizing, during the first stage $F_1$ the unit 27 ascertains that the pump 17 is operating on a (possibly variable) water quantity in the vessel 15 which always exceeds a minimum value (head) or zero, this corresponding to a large water quantity removed from the clothes during their drying. During the second stage $F_2$ the unit 27 detects a negative variation in the flow rate of the water fed by the pump 17 into the pipe 18, i.e. a negative gradient for the energy transferred by the fluid to the impeller 232. In this case the unit 27 ascertains a reduction in the discharge of water from the clothes.

During the third stage $F_3$ the control unit 27 calculates (on the basis of suitable known comparison algorithms) that there is no more water in the clothes and that the drying stage has thus terminated.

In this case the unit operates the contactor 34 to open it and thus halt the fans 7 and 13. The unit 27 also switches off the power feed to the resistor 8 and to the pump 17, which stops. As an alternative to operating on digital signals as described, the circuit of FIG. 15 can operate on analog signals.

In this case in place of the comparator 229 a usual threshold circuit can be used able to determine when the analog signal from the dynamo 230 falls below a threshold value.

FIG. 16 schematically illustrates a modification of the apparatus according to the invention. In this figure, parts corresponding to those of the already described figures are indicated by the same reference numerals.

In this figure the circuit by which hot air is produced is the refrigeration circuit of FIG. 5, which will not be further described.

In the apparatus according to the invention the unit 27 is again connected to a variable resistor 225 on which there operates a mobile element 256 connected by an arm 257 to a mobile flap 258 which intercepts the pipe 18. This resistor is fed by the unit With the embodiment of FIG. 16, the water passing through the pipe 18 (in variable quantity according to the particular point reached in the drying stage) transfers energy to the flap 258, which then moves to a greater or lesser extent from a rest position in which it lies on an element 29 and completely closes the pipe 18.

The energy transferred to the flap 258 varies according to the water flow through the pipe 18, and is determined by a variation in the ohmic value of the resistor 55. This variation is monitored by the unit 27.

Specifically, at the beginning of drying the flap 258 only minimally closes the pipe 18 (flap in a substantially vertical position in FIG. 16). Under these conditions the ohmic value of the resistor 255 is high.

As drying proceeds the flap 258 tends to move into contact with the element 259 with the result that the ohmic value of the resistor 255 falls.

The unit 27 detects this negative variation in the characteristics of the resistor 255 and halts drying (acting for example on the compressor 70 and timer 128) when this resistance remains substantially constant with time or when it falls below a suitable threshold value corresponding to practically zero energy transferred by the water to the flap 258.

This situation corresponds to complete drying of the clothes. It should be noted that a by-pass 280 provided with its own flap 281 mobile in opposition to the flap 258 is installed on the pipe 18. This by-pass allows natural gravity return of the water lying downstream of the flap 258 when drying has terminated, this water providing the usual head present in the vessel 15.

The apparatus of this embodiment of the invention can take a different form from those described herein.

One of these modified forms consists for example of using a normal flowmeter inserted into the pipe 18. This meter measures the water flow rate through the pipe on the basis of the transfer by the water of at least part of the energy transferred to the water by the pump. On the basis of said flow variation the unit 27 determines the variation in the water discharged by the clothes present in the drum 6.

This and other possible modifications fall within the scope of the present invention.

Independently of the constituent fabric of the clothes and their weight, the method and apparatus of the invention determine when the drying process is complete and when the means which implement it have to be halted.

This method can be implemented in a clothes dryer of any type without having to modify its drum, provided the machine comprises a closed-cycle circuit incorporating a heat exchanger for recovering the water removed from the clothes during the drying process.

Finally, the determination of the water quantity discharged by the clothes, and in particular the direct determination as described in relation to FIGS. 1 to 7, can by implemented discontinuously or continuously during the operation of the clothes dryer or the like.

We claim:

1. A method for controlling the drying stage in a clothes dryer machine comprising a drum, means for generating hot air circulation through the drum to dry the clothes contained therein, means for cooling said air, at least one vessel for collecting the water removed from said clothes by said air and condensed at said vessel during said circulation, and a pump for removing said water from said vessel, cyclically, characterized by measuring, for the purpose of controlling the drying stage of the clothes (5), the quantity of water released and collected by the clothes within a predetermined time ($T_1$, $T_{10}$) during their drying, and providing a signal for stopping the machine if the measurement obtained is less than a predetermined value.

2. A method as claimed in claim 1, characterized in that the quantity of water released by the clothes is measured directly by measuring the quantity of condensed water which collects in the collection vessel (15, 19).

3. A method as claimed in claim 1, characterized in that the quantity of water released by the clothes is measured indirectly.

4. A method as claimed in claim 2, characterized in that the water present in the collection vessel (15, 19) is measured discontinuously during the operation of the machine (1).

5. A method as claimed in claim 2, characterized in that the water present in the collection vessel (15, 19) is measured continuously during the operation of the machine (1).

6. A method as claimed in claim 2, characterized by cutting the power feed to the means (7, 8, 70) for providing hot air circulation through the drum, the air cooling means (13) and the pump (17) on the basis of the measured data concerning the water quantity present in the collection vessel (15, 19) and directly related to the water quantity released by the clothes.

7. A method as claimed in claim 2, characterized in that the water quantity in the collection vessel (15, 19) is evaluated on the basis of the water weight.

8. A method as claimed in claim 2, characterized in that the water quantity in the collection vessel (15, 19)

is evaluated on the basis of the determination of electrical members operationally connected to the water present in the vessel (15, 19).

9. A method as claimed in claim 3, characterized in that to indirectly evaluate the water quantity discharged by the clothes, the current absorbed by the pump (17) during the evacuation of the water from the collection vessel (15) is monitored, its variation during the drying of said clothes is determined, and based on this determination the means (7, 13, 8; 70) for providing hot air circulation through the drum (67) and air cooling are acted on to halt the drying stage when the gradient of said variation is negative and said current remains substantially constant with time.

10. A method as claimed in claim 9, characterized in that the variation in the current absorbed by the pump (17) is determined digitally.

11. A method as claimed in claim 9, characterized in that the variation in the current absorbed by the pump (17) is determined analogically.

12. A method as claimed in claim 9, characterized in that the variation in the current absorbed by the pump (17) is determined by measuring the variation in a quantity functionally associated with said current.

13. A method as claimed in claim 12, characterized in that the quantity associated with the current absorbed by the pump (17) is the drive torque generated by its motor.

14. A method as claimed in claim 12, characterized in that the quantity associated with the current absorbed by the pump (17) is the rotational speed of its motor.

15. A method as claimed in claim 3, characterized in that to indirectly evaluate the water quantity discharged by the clothes, at least part of the energy transferred by the pump (17) to the water during its evacuation from the collection vessel is used to move a member (232; 258) disposed in a pipe (18) connected to said pump (17), said energy varying during the drying stage and tending substantially to zero towards the end of said stage, the variation in said energy being representative of the discharge of water from the clothes during their drying and therefore of their state of dryness, drying being halted when the gradient of said variation is negative and the energy transferred remains substantially constant with time.

16. A method as claimed in claim 15, characterized in that the variation in the energy transferred to the mobile member (232; 258) is determined digitally.

17. A method as claimed in claim 15, characterized in that the variation in the energy transferred to the mobile member (232; 258) is determined analogically.

18. A method as claimed in claim 15, characterized in that the variation in the energy transferred to the mobile member (232; 258) is determined by measuring the rest state of said member.

19. A method as claimed in claim 1, characterized in that the variation in the energy transferred to the mobile member (232; 258) is evaluated on the basis of the variation in the rate of water flow through the pipe in which said member is disposed.

20. A clothes dryer machine comprising a drum, means for heating air, means for generating hot air circulation through the drum to dry the clothes contained therein, said air then being cooled, at least one vessel for collecting the water removed from said clothes by said air and condensed at said vessel during said circulation, and a pump for removing said water from said vessel, cyclically, said machine being characterized by measurement means (40, 50, 60, 76, 80; 129, 130, 160; 230, 235) to measure the quantity of collected water released from the clothes during their drying and to generate signals based on this measurement, said signals being fed to a control unit (27) which is connected to at least said means (7, 8; 13; 70) for heating the drying air or said means for generating the air circulation through the drum (6) said control unit (27) monitoring the variation in said measured water quantity and acting to interrupt operation of said machine when said variation has a negative gradient and when the signals originating from the measurement means (40, 50, 60, 76, 80; 129, 130, 160; 230, 235) correspond to a measured water quantity which is constant with time.

21. A machine as claimed in claim 20, characterized in that the measurement means (40, 50 . . . ; 230, 255) are of electrical mechanical type.

22. A machine as claimed in claim 21, characterized in that the measurement means are a dynamometer (40) connected to the condensed water collection vessel (15, 19), which is supported by a plate (30) resting on an elastic means (32) secured to a fixed part of the machine (1).

23. A machine as claimed in claim 22, characterized in that the plate (30) is associated with an earthing point (31) by means of a flexible connection, said plate comprising a contact (29) arranged to close onto a fixed contact (28) associated with the control unit (27).

24. A machine as claimed in claim 23, characterized in that the measurement means are a capacitor inserted in the vessel (15, 19).

25. A machine as claimed in claim 24, characterized in that the capacitor (50) is formed from parallel flat plates (51, 52), one of which (51) is connected to the control unit (27) and the other to an earthing point (53).

26. A machine as claimed in claim 21, characterized in that the measurement means are a resistor (60), advantageously of wire type, inserted into the collection vessel (15, 19), said resistor (60) having one end (61) connected to the control unit (27) and its other end (62) to an earthing point (63).

27. A machine as claimed in claim 21, characterized in that the measurement means are a variable resistor (76) connected at one end (75) to the control unit (27) and at its other end to an earthing point (77), said resistor being connected to a lever (78) which at one end carries a float (80) resting on the surface (5) of the water in the vessel (15, 19), said lever (78) acting on said resistor (76) in such a manner as to vary its ohmic value as the water quantity in the vessel varies.

28. A machine as claimed in claim 20, characterized in that the measurement means (129, 130, 60) are arranged to measure the current absorbed by the pump (17) during the evacuation of the water from the collection vessel (15) and to generate signals on the basis of this measurement.

29. A machine as claimed in claim 28, characterized in that the measurement means (129) are an ammeter.

30. A machine as claimed in claim 29, characterized in that the ammeter (129) is connected to a threshold circuit (130) connected to the control unit (27).

31. A machine as claimed in claim 28, characterized in that the measurement means (129) are a monitoring and comparison circuit operating on a signal ($V_C$) proportional to the drive torque of, and taken across the terminals of, the motor of the pump (17), and on a signal ($V_A$) representative of the duration of the power feed to said pump, said circuit defining the variation in the signal representative of the drive torque ($V_C$) and hence of the current absorbed by the pump (17) with time, to then feed a signal corresponding to this variation to the control unit (27) which, on the basis of said signal, operates on at least one of the means (7, 8, 13, 70) generating the air circulation through the drum (6) and heating the air, and on the pump (17).

32. A machine as claimed in claim 28, characterized in that the measurement means (129) are a comparator (141) which receives from the usual motor of the pump (17) a signal (V) corresponding to the torque generated by it, and compares this signal (V) with a threshold signal ($V_S$), on the basis of this comparison said comparator (141) generating a signal ($V_C$) which is fed to one input (142) of a logic circuit (143) arranged to compare this signal ($V_C$) substantially corresponding to the torque of the motor of the pump (17) generated in the presence of at least a suitable head of water in the collection vessel (15), with a signal ($V_A$) indicating the presence of power feed to the pump (17), said logic circuit generating a value 1 or 0 according to whether this comparison denotes valid water evacuation from said vessel or a water evacuation which is zero or less than the usual head always present in the vessel, said value 1 or 0 being fed to the control unit (27).

33. A machine as claimed in claim 28, characterized in that the measurement means are a tachometer dynamo (60) connected to the usual motor of the pump (17).

34. A machine as claimed in claim 20, characterized by comprising at least one mobile member (232, 258) disposed in a pipe (18) connected to the pump (17), and measurement means (230, 255) for measuring the energy transferred by the condensed water during its passage through said pipe to the mobile member (232, 258) and to generate electrical signals based on this measurement, said signals being fed to the control unit (27).

35. A machine as claimed in claim 34, characterized in that the measurement means (230) are a tachometer dynamo.

36. A machine as claimed in claim 35, characterized in that the tachometer dynamo (230) is connected to a threshold circuit (229) connected to the control unit (27).

37. A machine as claimed in claim 35, characterized in that the tachometer dynamo (230) is connected to a comparator member (229) connected to the control unit (27).

38. A machine as claimed in claim 34, characterized in that the mobile member (232) is an impeller disposed within the pipe (18) connected to the pump (7), said impeller being associated with an idle shaft at least partly emerging from said pipe and operationally connected to the tachometer dynamo (230).

39. A machine as claimed in claim 34, characterized in that the mobile member is an element (258) arranged to intercept the pipe (18) connected to the pump (17), said element (258) being connected to a member (256) which regulates a variable resistor (255), the ends of which are connected to the control unit (27).

40. A machine as claimed in claim 34, characterized in that the measurement means are a flow meter disposed in the pipe (18) connected to the pump (17).

41. A machine as claimed in claim 20, characterized in that the control unit (27) is a microprocessor circuit.

42. A machine as claimed in claim 20, characterized in that the control unit (27) acts on the power feed (35, 73) to the means (7, 8, 13, 70) for circulating, heating and cooling the air used to dry the clothes in the drum (6) of the machine (1), and on the power feed to the pump (17).

43. A machine as claimed in claim 42, characterized in that the control unit (27) controls a contactor (34, 74) arranged to close or open a power feed line (35, 73) to the means (7, 8, 13, 70) for circulating, heating and cooling the air used to dry the clothes in the drum (6) of the machine (1), said unit (27) controlling the operation of a timer (128) which enables power feed to the pump (17).

* * * * *